US007207821B1

(12) United States Patent
Ju

(10) Patent No.: US 7,207,821 B1
(45) Date of Patent: Apr. 24, 2007

(54) ELECTRICAL CONNECTOR WITH SUCTION PORTION

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/430,840

(22) Filed: May 10, 2006

(51) Int. Cl.
*H01R 13/62* (2006.01)

(52) U.S. Cl. ..... 439/331; 439/940

(58) Field of Classification Search ..... 439/331, 439/940, 73
See application file for complete search history.

(56) References Cited

U.S. PATENT DOCUMENTS 3,942,854 A * 3/1976 Klein et al. ..... 439/331
4,130,327 A * 12/1978 Spaulding ..... 439/71
4,504,105 A * 3/1985 Barkus et al. ..... 439/331
4,511,201 A * 4/1985 Baker et al. ..... 439/260
5,640,762 A * 6/1997 Farnworth et al. ..... 29/833
5,873,741 A * 2/1999 Belopolsky et al. ..... 439/73
6,231,365 B1 * 5/2001 Konno et al. ..... 439/331
6,244,875 B1 * 6/2001 McHugh et al. ..... 439/73

* cited by examiner

*Primary Examiner*—Michael C. Zarroli
(74) *Attorney, Agent, or Firm*—Troxell Law Office PLLC

(57) ABSTRACT

The present invention discloses an electrical connector including: an insulating body provided with a plurality of receiving holes; a plurality of electrical terminals received in the receiving holes; and a clamping part for clamping a chip module, provided with a suction portion having an elastic arm on its side, wherein there is a gap between the suction portion and the elastic arm. The electrical connector according to the present invention provides highly stable electrical contact between its electrical terminals and electrical devices.

13 Claims, 6 Drawing Sheets

ELECTRICAL CONNECTOR WITH SUCTION PORTION

FIELD OF THE INVENTION

The present invention relates an electrical connector and particularly to an electrical connector, which provides higher efficiency in manufacturing and assembling.

BACKGROUND OF THE INVENTION

The conventional electrical connector comprises an insulating body, electrical terminals received in the insulating body, and a clamping part for clamping a chip module. The clamping part is pivotally connected to one end of the body of the electrical connector is provided with a through hole in its middle. Both edges of the through extend inwards to form a clamped portion whose cross section is an arc shape. When the clamping part is turned tight, the clamping portion abuts against the chip module.

To enable the vacuum nozzle to lift up an electrical connector and position it at a circuit board, it is necessary to provide suction cap which is engaged with the clamping part described above and which is independently formed of the clamping part. For the electrical connector with the clamping part and the suction cap independently formed of each other, the clamping part and the suction cap have to be manufactured separately. It also demands one more step to retain the suction cap onto the clamping part, taking even more working hours.

Consequently, it is necessary to design a new electrical connector.

SUMMARY OF THE INVENTION

An object of the present invention is to provide an electrical connector which provides higher efficiency in manufacturing and assembling.

Another object of the present invention is to provide an electrical connector whose clamping part is provided with a suction portion having an elastic arm on its side, wherein there is a gap between the suction portion and the elastic arm to increase the efficiency in manufacturing.

In order to achieve the objects described above, an electrical connector according to the present invention comprises: an insulating body provided with a plurality of receiving holes; a plurality of electrical terminals received in the receiving holes; and a clamping part for clamping a chip module, provided with a suction portion having an elastic arm on its side, wherein there is a gap between the suction portion and the elastic arm.

Compared with the conventional technology, the electrical connector according to the present invention provides higher stability in electrical contact between its electrical terminals and electrical devices.

BRIEF DESCRIPTION OF THE DRAWINGS

The present invention can be more fully understood by reference to the following description and accompanying drawings, in which.

DETAILED DESCRIPTION OF THE INVENTION

Figure 1:
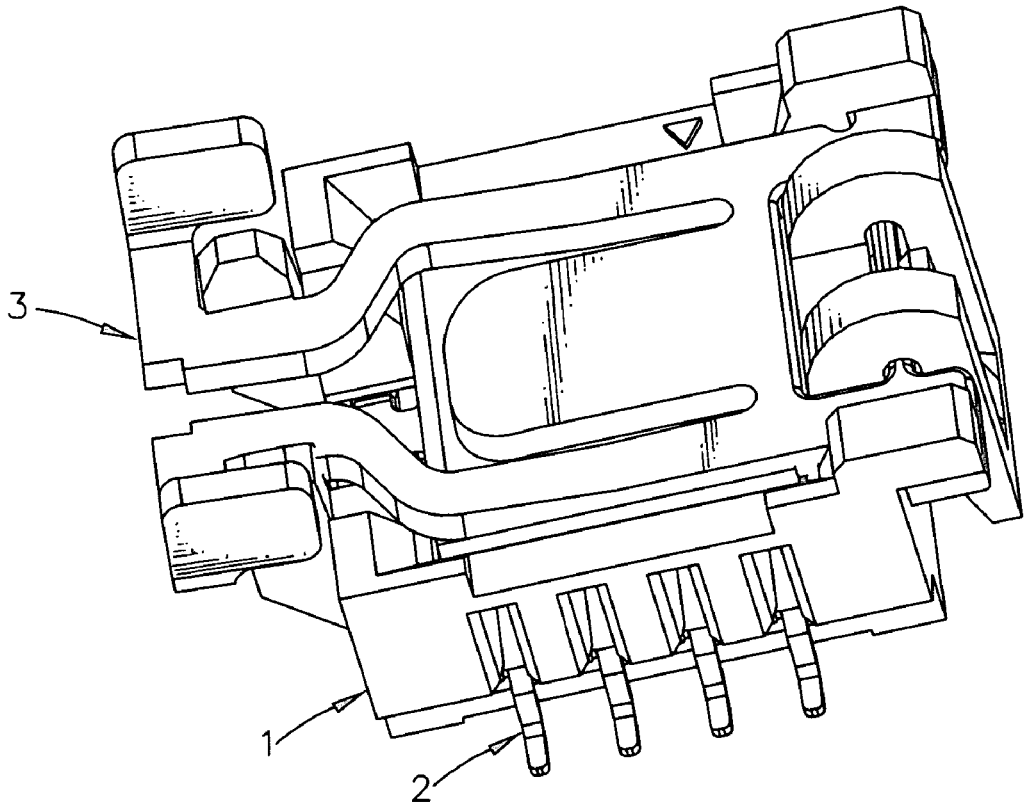
FIG. 1 schematically illustrates a perspective assembly view of a preferred embodiment of the electrical connector according to the present invention.
Figure 2:
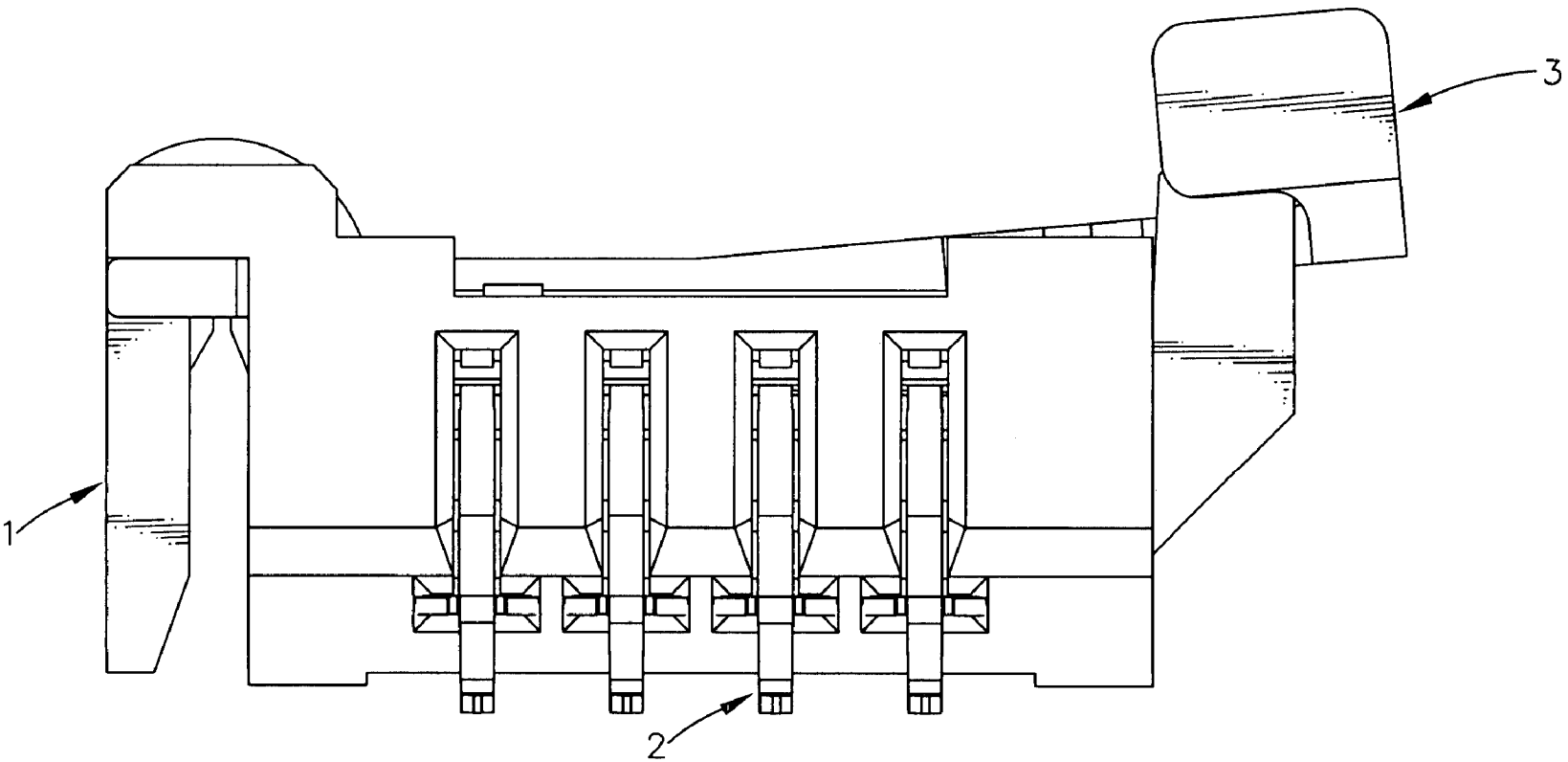
FIG. 2 schematically illustrates a front view of a preferred embodiment of the electrical connector according to the present invention.
Figure 3:
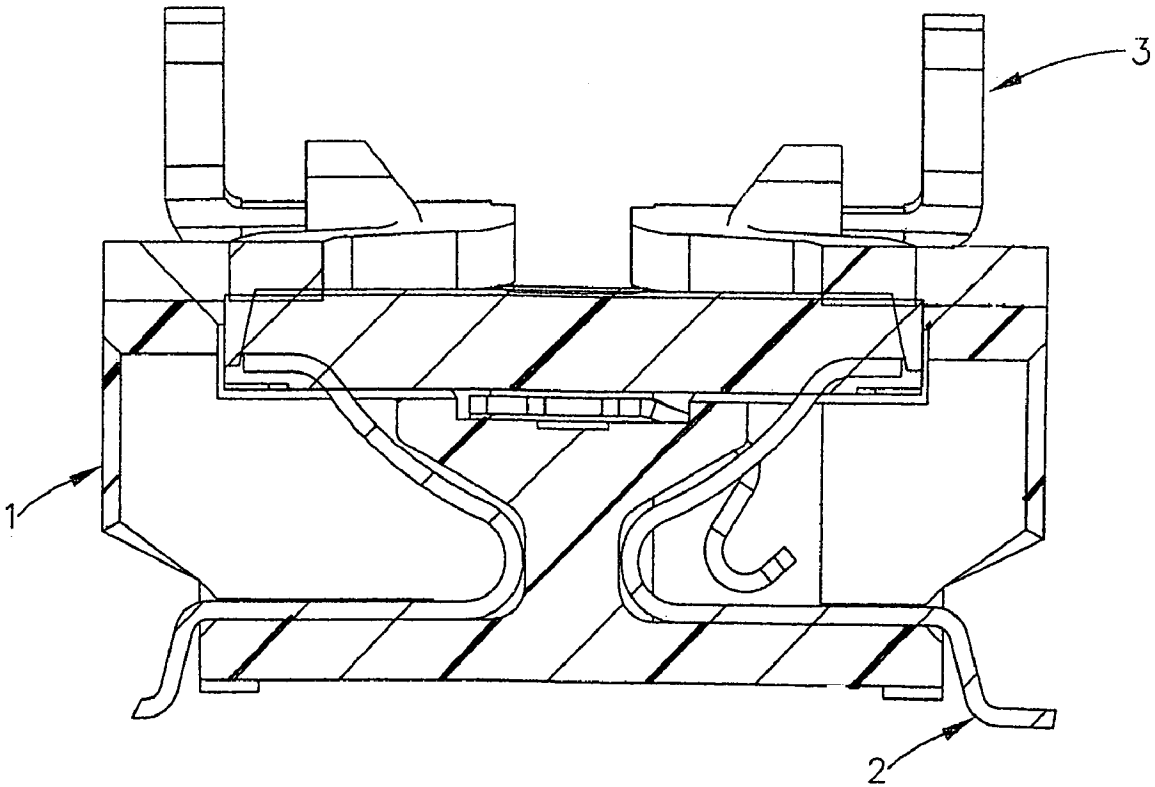
FIG. 3 schematically illustrates a cross-sectional view of a preferred embodiment of the electrical connector according to the present invention.
Figure 4:
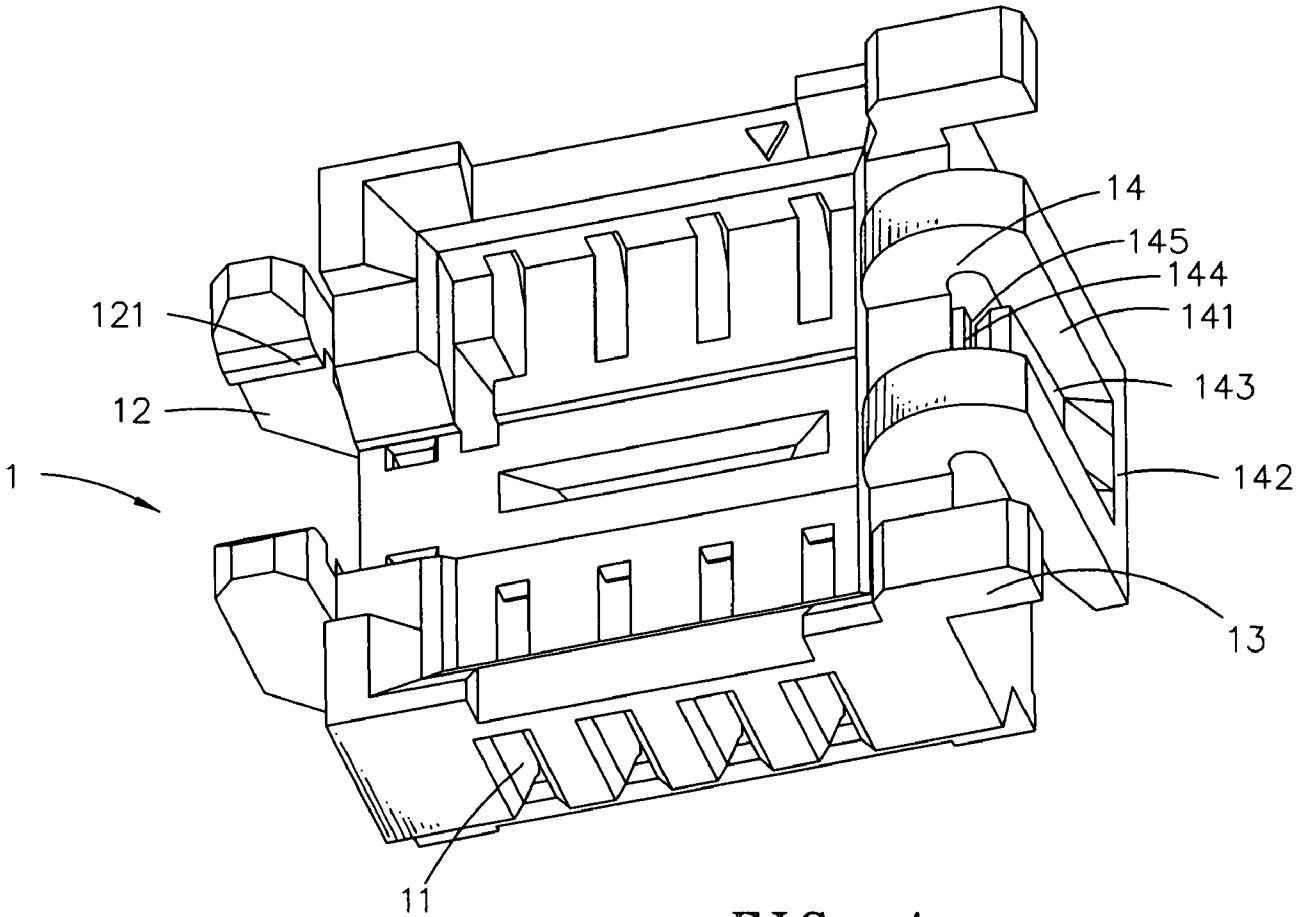
FIG. 4 schematically illustrates a perspective view of a preferred embodiment of the insulating body according to the present invention.
Figure 5:
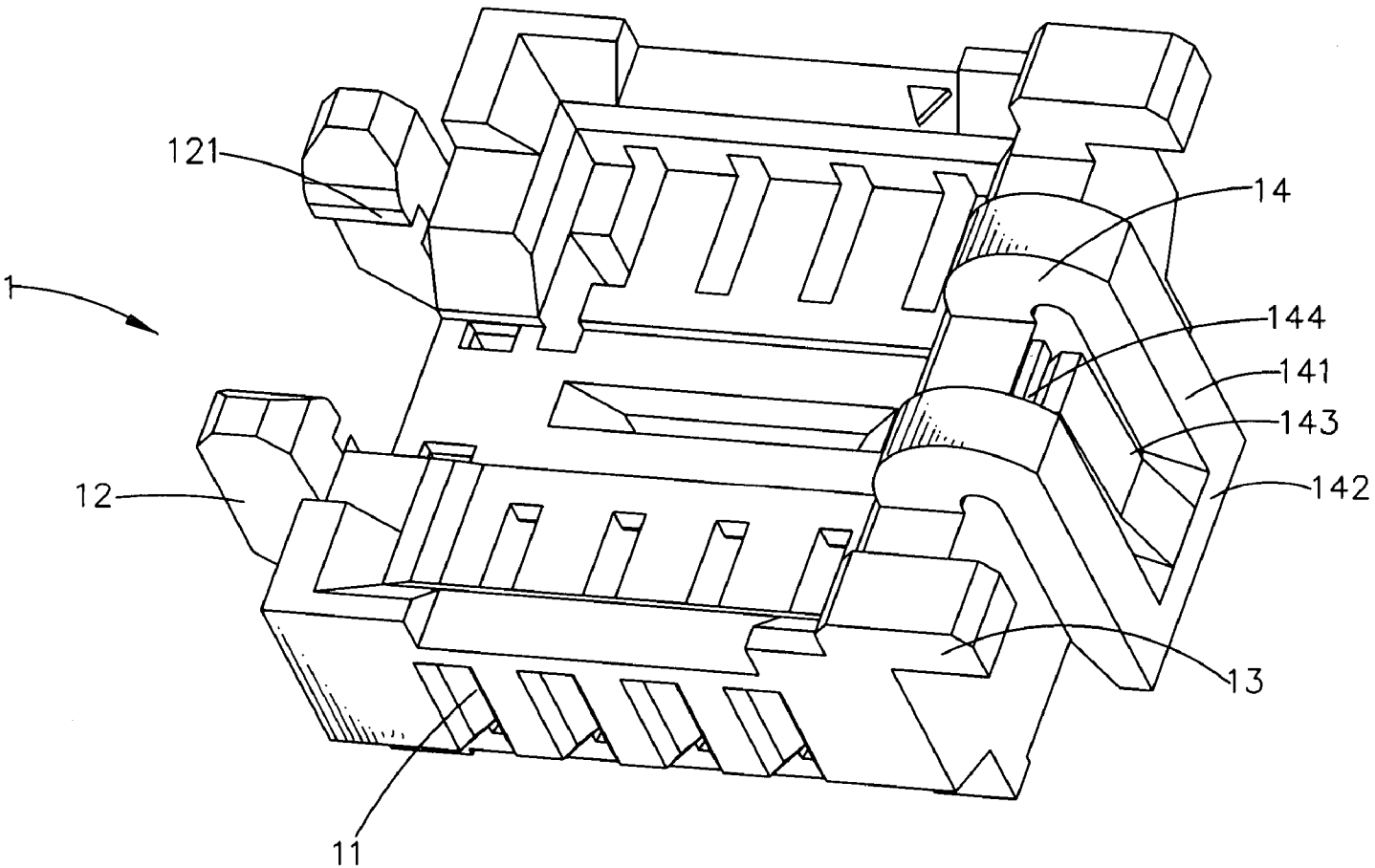
FIG. 5 schematically illustrates a perspective view of the electrical connector from another view angle.
Figure 6:
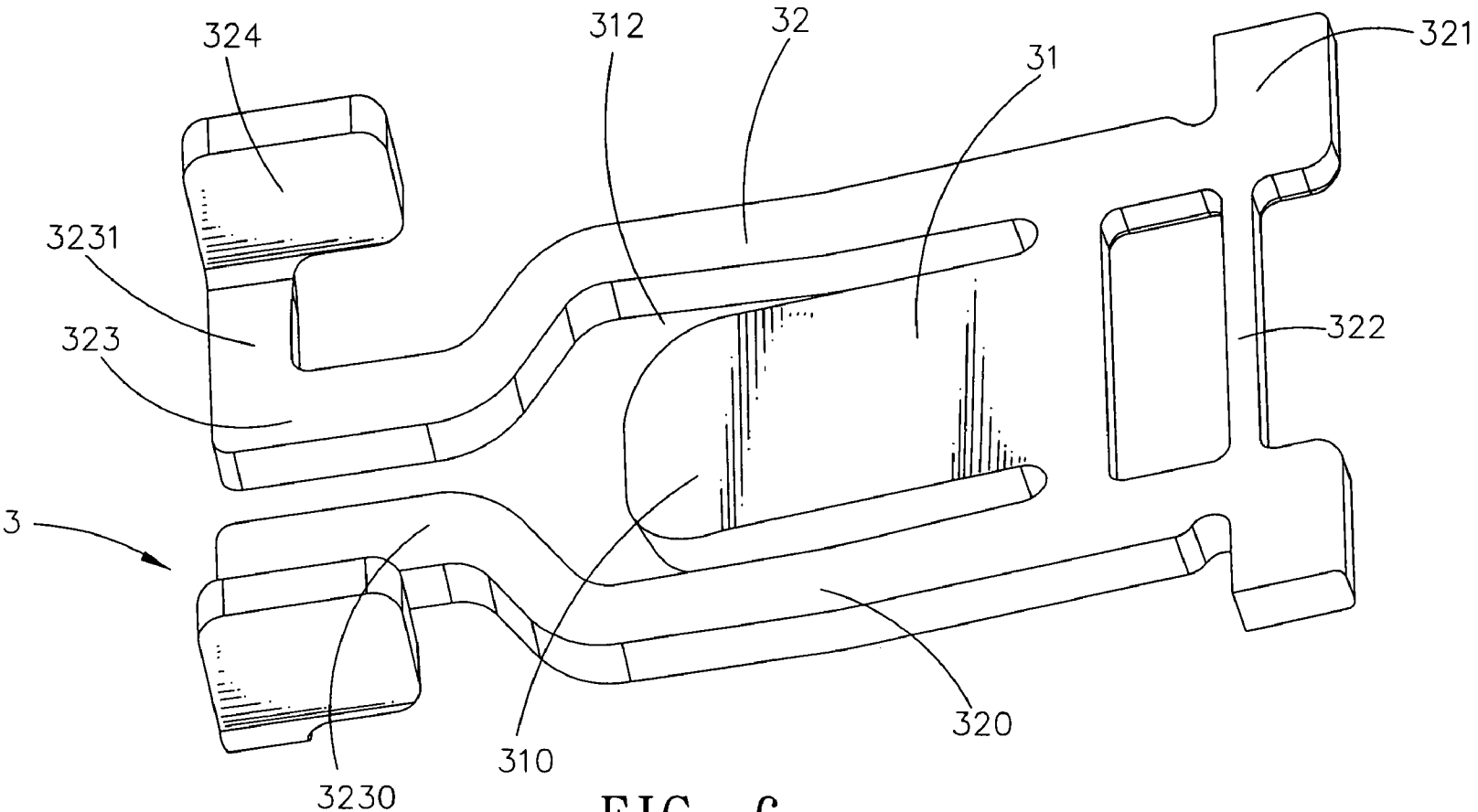
FIG. 6 schematically illustrates a perspective view of the clamping part according to the present invention.

Referring to FIGS. 1 to 6, the electrical connector according to the present invention comprises an insulating body 1 provided with a plurality of receiving holes; a plurality of electrical terminals 2 received in the receiving holes; and a clamping part 3 for clamping a chip module (not shown).

Receiving holes 11 are provided on the opposing sides of the middle of the insulating body 1 to receive the terminals 2. One end of the insulating body 1 extends to symmetrically form a first protrusion 12 whose upper portion protrudes inwards to form a first fastening hook 121. The other end of the insulating body 1 extends to symmetrically form a second protrusion 13 and at the same end close to the middle is provided with a hooking portion 14 adjacent to the second protrusion 13; the hooking portion 14 is, for example but not limited to, an arc shape. Furthermore, the end of the hooking portion 14 extends downwards vertically to form two vertical portions 141 connected by a horizontal portion 142. The middle of the horizontal portion 142 bends upwards and extends to form an elastic strip 143. A protruding strip 144 corresponding to the elastic strip 143 is provided on the middle of the end of the insulating body 1. There is a gap 145 between the elastic strip 143 and the protruding strip 144.

The middle of the clamping part 3 is provided a suction portion 31 whose two sides are symmetrically provided with two elastic arms 32. There is a gap 312 between the elastic arms 32 and the suction portion 31, wherein the suction portion 31 is provided with a flat surface and its end bends downwards and extends to form a bending portion 310, which can clamp the chip module. A roughly middle portion of the elastic arms 32 is provided with a clamping portion 320 bending downwards to clamp the chip module. One end of the elastic arms 32 extends backwards to form an opposing portion 321, which is connected by an shaft portion 322. The other end of the elastic arms 32 extend forwards to form two separate retaining portion 323 comprising a longitudinal piece 3230 and a transverse piece 3231 perpendicular to the longitudinal piece 3230, wherein one side of the transverse piece 3231 bends upwards and extends to form a pulling portion 324 perpendicular to the transverse piece 3231.

When the electrical connector according to the present invention is being assembled, the shaft portion 322 can first pass the gap 145 to engage with the location between protruding strip 144 and the upper end of the elastic strip 143, and further engages with the lower portion of the hooking portion 14. The clamping part 3 is then turned to render the opposing portion 321 to abut against the lower portion of the second protrusion 13. Finally, the retaining portion 323 of the clamping part 3 is retained on the first fastening hook 121 so as to secure the clamping part 3 onto the insulating body 1.

Consequently, by putting the present invention into practice, the clamping part is provided with a suction portion having an elastic arm on its side, and there is a gap between the suction portion and the elastic arm to increase the efficiency of manufacturing. The electrical connector according to the present invention can indeed overcome the drawbacks of the conventional electrical connector.

While the invention has been described with reference to the a preferred embodiment thereof, it is to be understood that modifications or variations may be easily made without departing from the spirit of this invention, which is defined by the appended claims.

What is claimed is:

1. An electrical connector, comprising:

an insulating body provided with a plurality of receiving holes;

a plurality of electrical terminals received in the receiving holes; and a clamping part for clamping a chip module, provided with a suction portion having an elastic arm on its side, wherein there is a gap between the suction portion and the elastic arm, wherein one end of the elastic arm is provided with a retaining portion and the retaining portion comprises a longitudinal piece and a transverse piece perpendicular to the longitudinal piece and one side of the transverse piece bends upwards and extends to form a pulling portion perpendicular to the transverse piece.

2. The electrical connector as defined in claim 1, wherein the suction portion is provided with a flat surface.

3. The electrical connector as defined in claim 1, wherein the elastic arm is provided with a clamping portion.

4. The electrical connector as defined in claim 1, wherein one end of the elastic arm is extendingly provided with an opposing portion.

5. The electrical connector as defined in claim 4, wherein the suction portion is extendingly provided with an elastic arm having an opposing portion at each side and the two opposing portions are connected by a shaft portion wherein the suction portion is provided with another elastic arm on another side, the two opposing portions extending from the elastic arms being connected by a shaft portion.

6. The electrical connector as defined in claim 1, wherein the pulling portion is perpendicular to the retaining portion.

7. The electrical connector as defined in claim 1, wherein the other end of the elastic arm also extends to form an elastic arm having a retaining portion at each side and the two retaining portions are separate, wherein the suction portion is provided with another elastic arm at another side, the two remaining portions extending from the elastic arms being separated from each other.

8. The electrical connector as defined in claim 1, wherein one end of the suction portion is provided with a bending portion to clamp the chip module.

9. An electrical connector, comprising:

an insulating body provided with a plurality of receiving holes;

a plurality of electrical terminals received in the receiving holes; and a clamping part for clamping a chip module, provided with a suction portion having an elastic arm on its side, wherein there is a gap between the suction portion and the elastic arm, wherein one end of the insulating body extends to symmetrically form a first protrusion whose upper portion protrudes inwards to form a first fastening hook, wherein both sides of the other end of the insulating body extends to symmetrically form a second protrusion and at the same end close to the middle is provided with a hooking portion adjacent to the second protrusion.

10. The electrical connector as defined in claim 9, wherein the hooking portion is an arc shape.

11. The electrical connector as defined in claim 9, wherein the end of the hooking portion extends downwards vertically to form two vertical portions connected by a horizontal portion and the middle of the horizontal portion bends upwards and extends to form an elastic strip.

12. The electrical connector as defined in claim 11, wherein a protruding strip corresponding to the elastic strip is provided in the middle of the end of the insulating body and there is a gap between the elastic strip and the protruding strip.

13. An electrical connector, comprising:

an insulating body provided with a plurality of receiving holes;

a plurality of electrical terminals received in the receiving holes; and a clamping part for clamping a chip module, provided with a suction portion having an elastic arm on its side, wherein there is a gap between the suction portion and the elastic arm, wherein the suction portion is extendingly provided with an elastic arm having an opposing portion at each side and the two opposing portions are connected by a shaft portion, wherein the suction portion is further provided with another elastic arm on another side, the two opposing portions extending from the elastic arms being connected by a shaft portion.

* * * * *